US008593912B1

(12) United States Patent
Amores

(10) Patent No.: US 8,593,912 B1
(45) Date of Patent: Nov. 26, 2013

(54) MULTIMEDIA ALARM CLOCK PROJECTOR

(76) Inventor: William Amores, Homestead, FL (US)

( * ) Notice: Subject to any disclaimer, the term of this patent is extended or adjusted under 35 U.S.C. 154(b) by 72 days.

(21) Appl. No.: 13/450,001

(22) Filed: Apr. 18, 2012

(51) Int. Cl.
*G04C 17/00* (2006.01)

(52) U.S. Cl.
USPC ..... 368/79; 368/239

(58) Field of Classification Search
USPC ..... 368/82–84, 239–242, 79, 256
See application file for complete search history.

(56) References Cited

U.S. PATENT DOCUMENTS

| | | | | | |
|---|---|---|---|---|---|
| 2,290,811 | A * | 7/1942 | Nassoit | 368/76 |
| 2,486,425 | A * | 11/1949 | Loewe et al. | 353/40 |
| 3,136,210 | A * | 6/1964 | Barrett | 368/79 |
| 4,285,028 | A * | 8/1981 | Sundin et al. | 362/35 |
| 4,497,582 | A * | 2/1985 | Lipman et al. | 368/15 |
| 5,122,997 | A * | 6/1992 | Schneider et al. | 368/294 |
| 5,638,339 | A * | 6/1997 | DeLoretto et al. | 368/10 |
| 6,565,253 | B1 * | 5/2003 | Yang | 368/294 |
| D567,673 | S * | 4/2008 | Chu et al. | D10/15 |
| 2004/0145114 | A1 * | 7/2004 | Ippolito et al. | 273/148 R |
| 2011/0141856 | A1 | 6/2011 | Cho et al. | |
| 2012/0242908 | A1 * | 9/2012 | Tsukagoshi | 348/734 |
| 2013/0037461 | A1 * | 2/2013 | Biewer et al. | 210/85 |

* cited by examiner

*Primary Examiner* — Sean Kayes
(74) *Attorney, Agent, or Firm* — Albert Bordas, P.A.

(57) ABSTRACT

A multimedia alarm clock projector having a housing assembly, a speaker system, and a projector assembly. The projector assembly has a projector having a focusing ring and lens. The projector further has electrical wiring, a mount assembly, and first base. The first base is mounted onto the housing assembly. The projector projects a visual projection at any angle between a horizontal plane to an vertical plane. The projector assembly further has a stationary ring fixed to the housing assembly. The stationary ring has a first lip. The projector assembly further has a rotational base plate with a second lip, a second base, and a channel. The rotational base plate is rotatably mounted onto the stationary ring, whereby the channel receives the first lip. The projector is mounted onto the rotational base plate. The rotational base plate comprises a cavity. The multimedia alarm clock further has a remote control.

20 Claims, 5 Drawing Sheets

MULTIMEDIA ALARM CLOCK PROJECTOR

BACKGROUND OF THE INVENTION

1. Field of the Invention

The present invention relates to alarm clocks, and more particularly, to multimedia alarm clock projectors.

2. Description of the Related Art

Many different shapes and types of multimedia alarm clocks have been designed in the past and are available in the marketplace today. Most of them are analog representations of the next. A large number of those multimedia alarm clocks share extremely similar features and technology. Newer alarm clocks have an integration of an external musical media player, such as an "I-POD" to which one can attach to the alarm clock and program to play music or selected media via incorporated speakers in the alarm clock. None have the novel features of the present invention, namely a multimedia alarm clock projector comprising combined audio and visual features.

Applicant believes that one of the closest references corresponds to U.S. Patent Application Publication No. 20110141856 A1, published on Jun. 16, 2011 to Kuo-Hsiung Cho, et al. for Multimedia Projection Alarm Clock with Integrated Illumination. However, it differs from the present invention because Kuo-Hsiung Cho, et al. teach a multimedia projection alarm clock with integrated illumination including a projector module, which projects an animated image, an illuminating light source, which emits illuminating light of adjustable color and/or brightness, a speaker which outputs music or sound effects, and a control unit, which animates a projected image and/or varies an illuminating light with music or sound effects so that an alarm signal featuring a theme of vivid figures with matching backgrounds may be provided. The control unit is also equipped with a simple user interface allowing the user to access handy bedside functions such as the night-light easily.

Other patents describing the closest subject matter provide for a number of more or less complicated features that fail to solve the problem in an efficient and economical way. None of these patents suggest the novel features of the present invention.

SUMMARY OF THE INVENTION

The present invention is a multimedia alarm clock projector comprising full range wireless speakers, wireless connectivity to a portable media player, and an integrated high resolution and/or high definition visual projector. These features permit a user to set an alarm clock to wake with combined audio and visual media. The multimedia alarm clock projector combines the flexibility of using a compact digital-light-processor or a laser projector to display visual media onto any surface.

More specifically, the present invention is a multimedia alarm clock projector, comprising a housing assembly, a speaker system; and a projector assembly. The projector assembly comprises a projector having a focusing ring and lens. The projector further has electrical wiring, and a mount assembly and first base. The first base is mounted onto the housing assembly. The projector projects a visual projection at any angle between an approximate horizontal plane to an approximate vertical plane. The projector assembly further comprises a stationary ring fixed to the housing assembly. The stationary ring has a first lip. The projector assembly further comprises a rotational base plate comprising a second lip, a second base, and a channel. The rotational base plate is rotatably mounted onto the stationary ring, whereby the channel receives the first lip. The projector is mounted onto the rotational base plate. The rotational base plate comprises a cavity. The cavity partially receives the projector when the projector projects the visual projection at the approximate vertical plane. The multimedia alarm clock further comprises a remote control.

The housing assembly comprises a top wall, a bottom wall, first and second lateral walls, a front wall, and a rear wall. The bottom wall has legs protruding therefrom. The top wall comprises a dock station assembly. The dock station assembly comprises first and second dock stations, an adaptor, and a connector. The top wall further comprises a universal serial bus connector. The front wall comprises a display assembly. The display assembly comprises a display panel, an informational display panel, an alarm indicator, and auxiliary indicator, a radio indicator, a universal serial bus connector indicator, and a short-wavelength radio transmission indicator. The rear wall comprises a video-in jack, a video-out jack, an auxiliary-in jack, an auxiliary-out jack, an antenna jack, an electrical outlet, a power supply cable, and a power supply. The rear wall further comprises a first and second time select switches, a time switch, an alarm switch, a reset switch, a program select switch, and a short-wavelength radio transmission switch. The bottom wall comprises a battery compartment and at least one ventilation hole.

It is therefore one of the main objects of the present invention to provide a multimedia alarm clock projector comprising full range wireless speakers, wireless connectivity to a portable media player, and an integrated high resolution and/or high definition visual projector.

It is another object of this invention to provide a multimedia alarm clock projector having features to permit a user to set an alarm clock to wake with combined audio and visual media.

It is another object of this invention to provide a multimedia alarm clock projector having features to permit a user to adjust a projected image angle at the projector.

It is another object of this invention to provide a multimedia alarm clock projector that combines the flexibility of using a compact digital-light-processor or a laser projector to display visual media onto any surface.

It is another object of this invention to provide a multimedia alarm clock projector that is volumetrically efficient for carrying, transporting, and storage.

It is another object of this invention to provide a multimedia alarm clock projector that can be readily assembled and disassembled without the need of any special tools.

It is another object of this invention to provide a multimedia alarm clock projector, which is of a durable and reliable construction.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
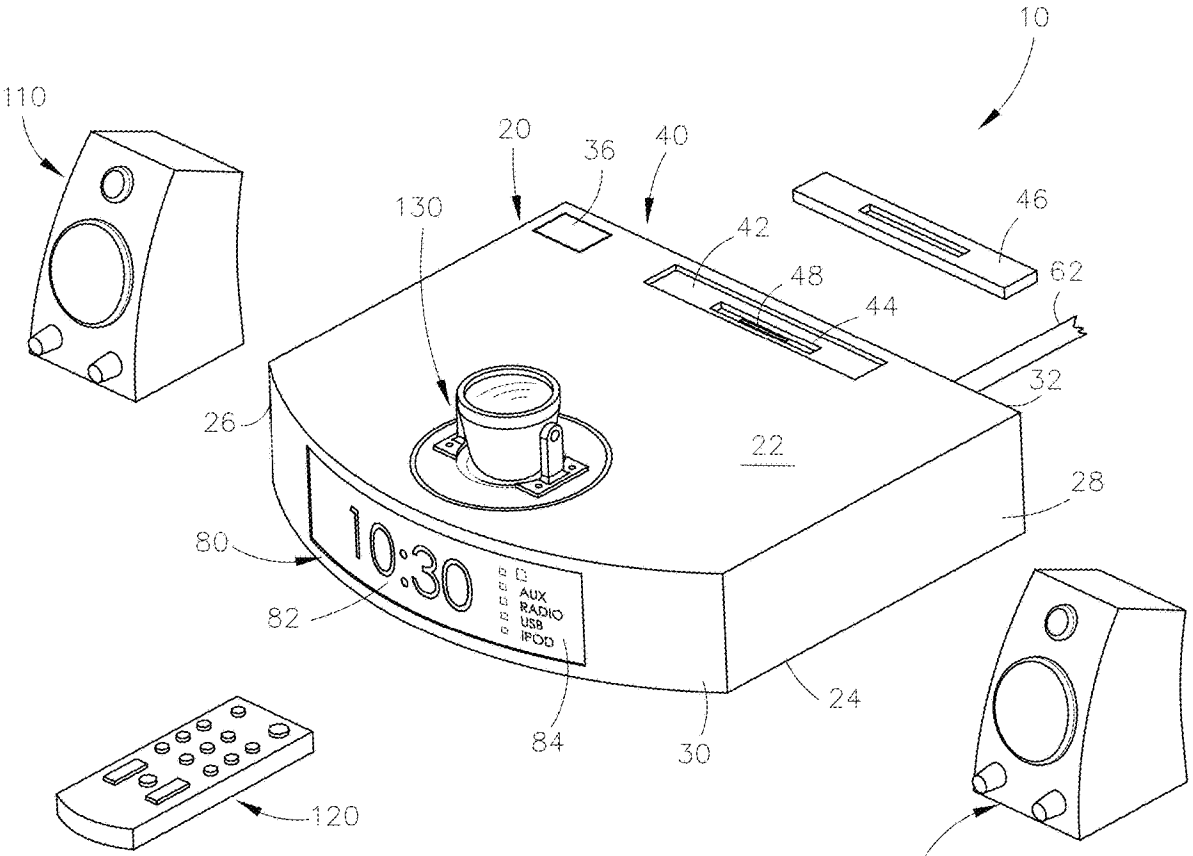
FIG. 1 represents an isometric view of a multimedia alarm clock projector.

Referring now to the drawings, the present invention is a multimedia alarm clock projector, and is generally referred to with numeral 10.

As seen in FIG. 1, multimedia alarm clock projector 10 comprises housing assembly 20, speaker system 110, remote control 120, and projector assembly 130.

Housing assembly 20 comprises top wall 22, bottom wall 24, first and second lateral walls 26 and 28 respectively, front wall 30, and rear wall 32. Top wall 22 comprises dock station assembly 40. Dock station assembly 40 comprises first and second dock stations 42 and 44, adaptor 46, and connector 48. First and second dock stations 42 and 44, and adaptor 46 receive for using and charging any portable media players, smart phones, or tablet computers. Such portable media players, smart phones, and tablet computers include those manufactured by Apple, Inc., including but not limited to, all "I-POD"s, "I-PHONE"s, and "I-PAD"s, and any other portable Apple, Inc. product. Thus, allowing the flexibility of using portable media players, smart phones, and tablet computers to stream music and video content, and/or use their respective applications.

In a preferred embodiment, top wall 22 further comprises universal serial bus, also defined as USB, connector 36. USB 36 may receive connection from any USB flash drive. In a preferred embodiment, USB 36 is approximately 5 watt. The USB flash drive being a data storage device that includes flash memory to store pictures, videos and music, and will allow the option and compatibility to read and display such media from this source when selected, increasing the efficiency and added value of present invention 10. USB 36 may also receive connection from smartphones such as the "SAMGSUNG GALAXY S" and other media players. As an example, the "SAMGSUNG GALAXY S" features a 1 GHz ARM "Hummingbird" processor, 8-16 GB internal Flash memory, a 4-inch 480×800 pixel Super AMOLED capacitive touchscreen display, Wi-Fi connectivity, a 5-megapixel camera with a maximum resolution of 2560×1920 and, on select models, a front-facing 0.3 MP VGA camera (640×480). In addition, it features a PowerVR graphics processor, yielding 20 million triangles per second, and upon release was both the first Android phone to be certified for DivX HD, and at 9.9 mm was the thinnest smartphone available.

Front wall 30 comprises display assembly 80. Display assembly 80 comprises display panel 82, informational display panel 84, alarm indicator 86 to indicate an alarm mode status, auxiliary indicator 88 to indicate an auxiliary mode status, radio indicator 90 to indicate a radio mode status, universal serial bus connector indicator 92 to indicate a universal serial bus connector mode status, portable media player indicator 94 to indicate a portable media player mode status, and short-wavelength radio transmission indicator 96 to indicate a short-wavelength radio transmission mode status in the event of use of a "BLUETOOTH" device. Use of a "BLUETOOTH" device enables a personal area network with any fixed or mobile device used with present invention 10. In a preferred embodiment, display assembly 80, and specifically display panel 82 and informational display panel 84 are liquid crystal displays, or technologies having similar characteristics and functionalities, that display date and time, as well as any selected customizable features selected. Present invention 10 also features an integrated am/fm radio with multiple presets for saving favorite radio stations.

In a preferred embodiment, speaker system 110 comprises wireless connectivity features. Speaker system 110 may be a pair of full range hi fidelity speakers that generate all mid to low frequencies; and a pair of tweeters responsible for generating all hi frequencies. As illustrated, the speakers of speaker system 110 will be housed in independent enclosures and additionally feature a passive radiator design, to reproduce all low frequency or tones. Each independent enclosure also has one mid speaker or "driver" at its bottom, and a tweeter at its upper half. When activated, speaker system 110 will produce a full spectrum of sound demonstrating astounding clarity, depth and power. Further, the independent enclosures can optionally be detached from housing assembly 20 to be placed in a room on any surface, whereby "BLUETOOTH" wireless technology is used to produce audio and digital signal processing for superior sound quality.

Remote control 120 is a full-featured remote control, allowing full operation and programming of present invention 10. Remote control 120 comprises "BLUETOOTH" connectivity, motion sensor enabled capabilities and voice control.

Figure 2:
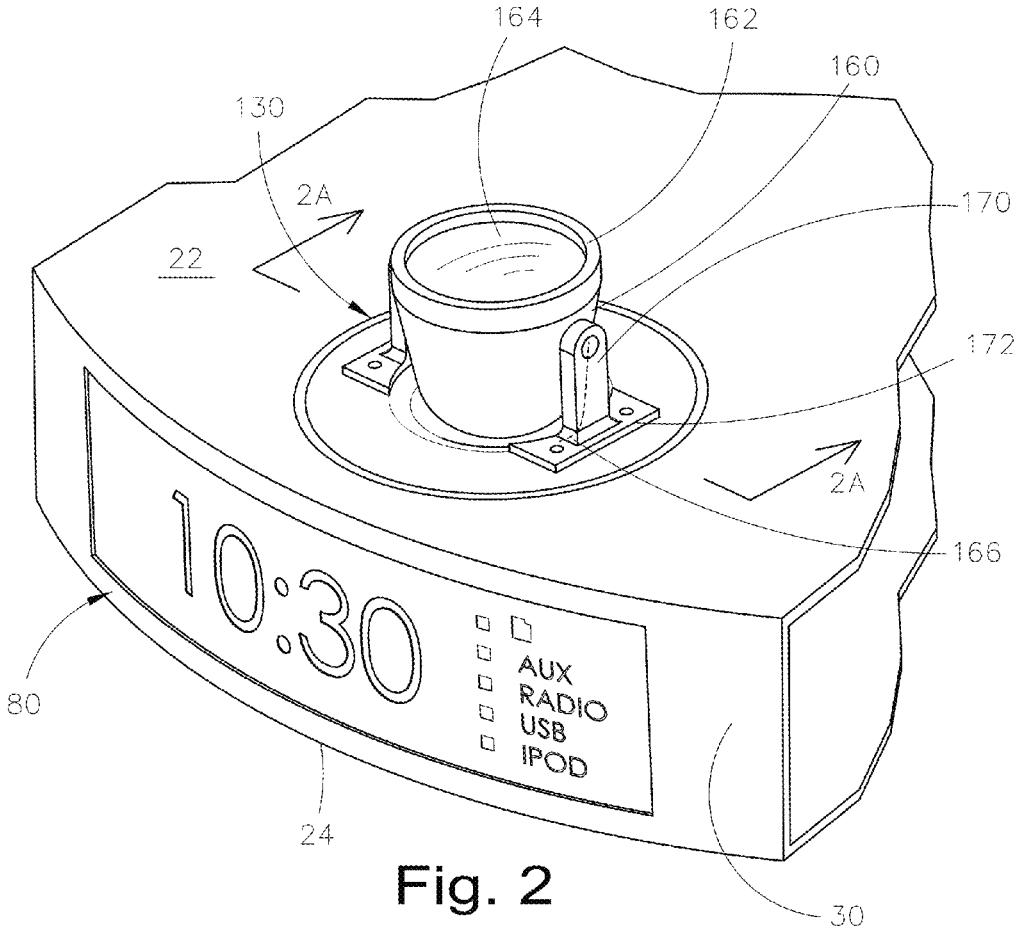
FIG. 2 is a section taken from area line 2 in FIG. 1, showing an enlarged view of the projector assembly.
Figure 2A:
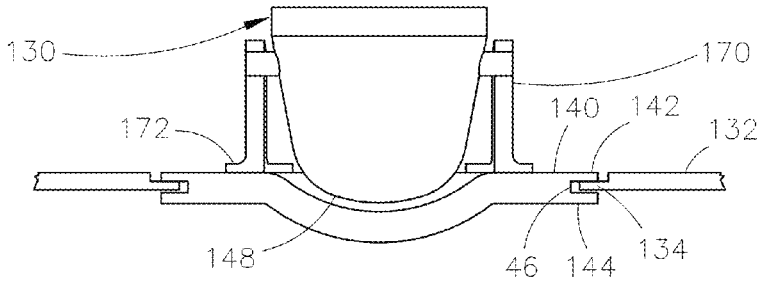
FIG. 2A is a cut view taken along the lines 2A-2A in FIG. 2, showing a stationary ring and rotational base plate.

As seen in FIGS. 2 and 2A, projector assembly 130 comprises projector 160 having focusing ring 162 and lens 164. Projector 160 further has electrical wiring 166, mount assembly 170, and first base 172 that is mounted onto housing assembly 20. Projector 160 projects a visual projection at any angle between an approximate horizontal plane to an approximate vertical plane. At the approximate horizontal plane, the visual projection is above or beyond top wall 22 so that top wall 22 does not block or interfere the visual projection.

As best seen in FIG. 2A, projector assembly 130 further comprises stationary ring 132 fixed to housing assembly 20. Stationary ring 132 has first lip 134. Projector assembly 130 further comprises rotational base plate 140 comprising second lip 142, second base 144, and channel 146. Rotational base plate 140 is rotatably mounted onto stationary ring 132, whereby channel 146 receives first lip 134. Projector 160 is mounted onto rotational base plate 140 that further comprises cavity 148. Cavity 148 partially receives projector 160 when projector 160 projects the visual projection at the approximate vertical plane. Projector 160 is a high-resolution video projector, featuring bright vivid colors, automatic focusing, and a short throw ratio to enjoy large images in small confined spaces, and the ability to display the current time if desired.

Figure 3:
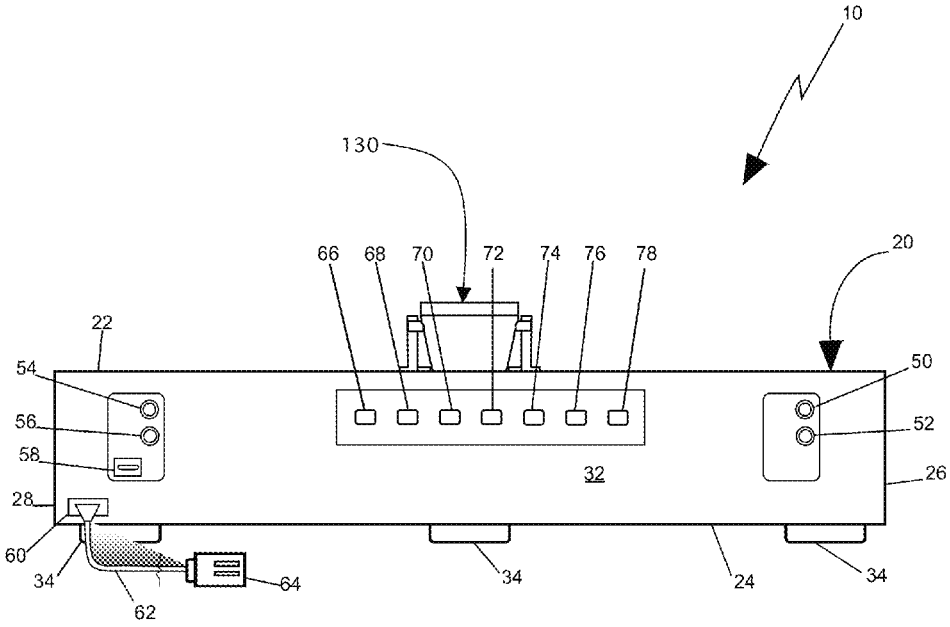
FIG. 3 is a rear view of the invention.

As seen in FIG. 3, rear wall 32 comprises video-in jack 50 and video-out jack 52 to send video to and from any external source, auxiliary-in jack 54 allowing for connecting any other mp3, cd, or other media players, auxiliary-out jack 56, antenna jack 58, electrical outlet 60, power supply cable 62, and power supply 64. Rear wall 32 further comprises first and second time select switches 66 and 68, time switch 70, alarm switch 72, reset switch 74, program select switch 76, and short-wavelength radio transmission switch 78. As seen in this illustration, bottom wall 24 has legs 34 protruding therefrom. Present invention 10 may also comprise an audio output to allow for sending audio to any external source, such as an amplifier or receiver, etc.

Figure 4:
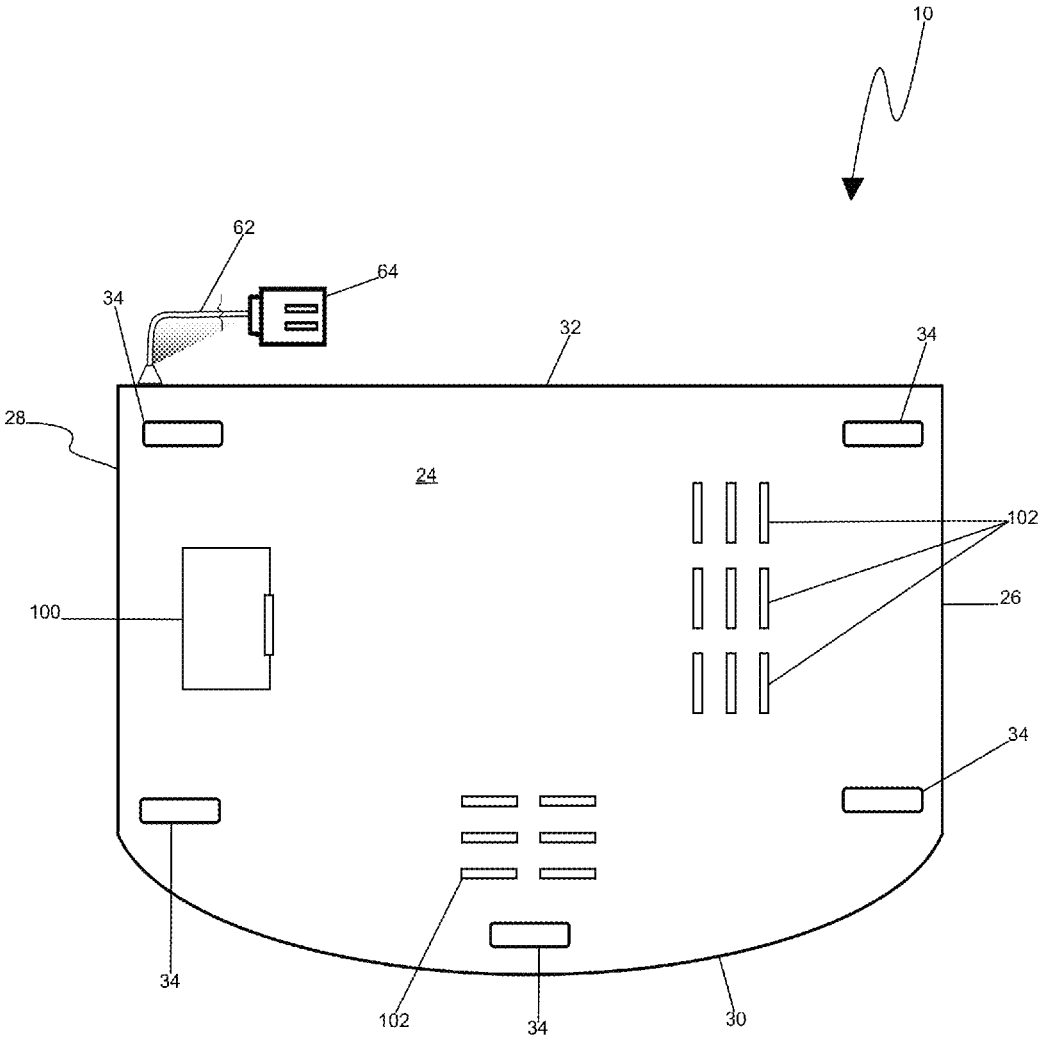
FIG. 4 is a bottom view of the invention.

As best seen in FIG. 4, bottom wall 24 comprises battery compartment 100 and at least one ventilation hole 102. Battery compartment 100 may keep a rechargeable battery such as a lithium ion battery, not seen. Power supply cable 62 and power supply 64 may recharge the rechargeable battery. Although not illustrated, it is noted that present invention 10 may further comprise a charger having a universal serial bus connector for use in a vehicle, and/or a headphone jack.

Figure 5:
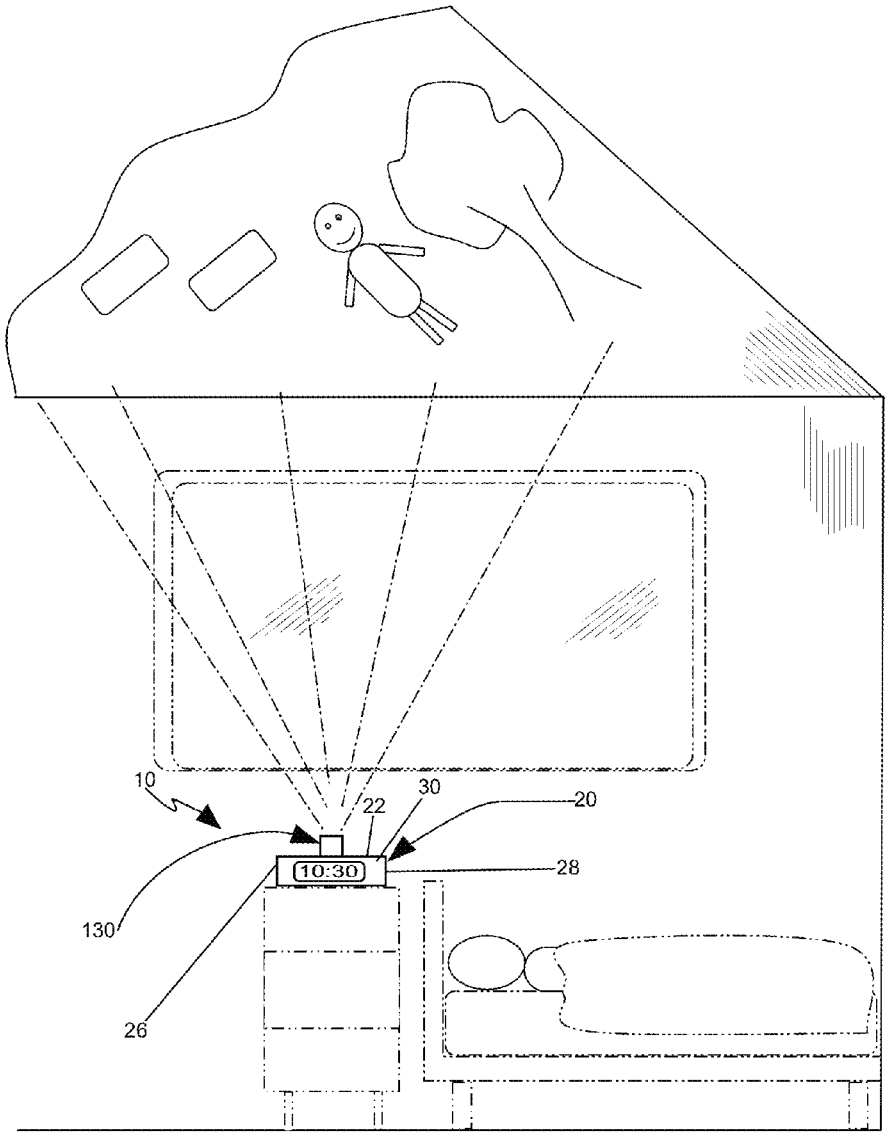
FIG. 5 is a representation of the present invention projecting an image onto the ceiling of a room.

As seen in FIG. 5, in operation a user can place present invention 10 in a room, such as a bedroom. Once placed into position, projector 160, mounted onto rotational base plate 140, is rotated in the direction of a desired screen and/or wall on which a projection will be projected onto. If a sidewall is desired, projector 160 is positioned to project the visual projection at an approximate horizontal plane, or elevated if desired. Focusing ring 162 may then be adjusted if desired. If the ceiling of the room is desired as seen in this illustration, projector 160 is positioned to project the visual projection at an approximate vertical plane, or angled if desired. Focusing ring 162 may then be adjusted if desired.

Present invention 10 is fully programmed. Once programmed as desired, a user can wake to music and/or audible sounds while viewing favorite media. Adding to the extreme customizability and value of present invention 10, the user will now, like never before, be able to program and select what to listen to and view. Thus, bringing the next evolutionary step to the alarm clock. By incorporating a visual display aspect with a fully integrated high definition projector with projector assembly 130 to an alarm clock system, the user will be able to not only be moved to the emotion of what he/she hears, by selecting inspirational music, radio, and other audible media; but can also be further engaged with the moment, by viewing their favorite selected pictures, slideshows, videos, and any other creative projects visually.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A multimedia alarm clock projector, comprising:

housing assembly comprising a time display and a docking port;

a detached speaker system;

a projector assembly comprising a projector having a focusing ring and lens, said projector further having electrical wiring, and a mount assembly and first base, said first base mounted onto said housing assembly;

the projector assembly comprises a tongue in groove configuration to facilitate rotational mounting of the projector on the housing assembly; and the housing assembly does not comprise an speaker system housed therein.

2. The multimedia alarm clock projector set forth in claim 1, further characterized in that said projector projects a visual projection at any angle between an approximate horizontal plane to an approximate vertical plane.

3. The multimedia alarm clock projector set forth in claim 1, further characterized in that said projector assembly further comprises a stationary ring fixed to said housing assembly, said stationary ring having a first lip.

4. The multimedia alarm clock projector set forth in claim 3, further characterized in that said projector assembly further comprises a rotational base plate comprising a second lip, a second base, and a channel.

5. The multimedia alarm clock projector set forth in claim 4, further characterized in that said rotational base plate is rotatably mounted onto said stationary ring, whereby said channel receives said first lip.

6. The multimedia alarm clock projector set forth in claim 5, further characterized in that said projector is mounted onto said rotational base plate.

7. The multimedia alarm clock projector set forth in claim 6, further characterized in that said rotational base plate comprises a cavity.

8. The multimedia alarm clock projector set forth in claim 7, further characterized in that said cavity partially receives said projector when said projector projects said visual projection at said approximate vertical plane.

9. The multimedia alarm clock projector set forth in claim 1, further comprising a remote control.

10. The multimedia alarm clock projector set forth in claim 1, further characterized in that said housing assembly comprises a top wall, a bottom wall, first and second lateral walls, a front wall, and a rear wall, said bottom wall having legs protruding therefrom.

11. The multimedia alarm clock projector set forth in claim 10, further characterized in that said top wall comprises a dock station assembly, said dock station assembly comprising first and second dock stations, an adaptor, and a connector.

12. The multimedia alarm clock projector set forth in claim 11, further characterized in that said top wall further comprises a universal serial bus connector.

13. The multimedia alarm clock projector set forth in claim 10, further characterized in that said front wall comprises a display assembly, said display assembly comprising a display panel, an informational display panel, an alarm indicator, and auxiliary indicator, a radio indicator, a universal serial bus connector indicator, a portable media player indicator, and a short-wavelength radio transmission indicator.

14. The multimedia alarm clock projector set forth in claim 10, further characterized in that said rear wall comprises a video-in jack, a video-out jack, an auxiliary-in jack, an auxiliary-out jack, an antenna jack, an electrical outlet, a power supply cable, and a power supply.

15. The multimedia alarm clock projector set forth in claim 10, further characterized in that said rear wall comprises a first and second time select switches, a time switch, an alarm switch, a reset switch, a program select switch, and a short-wavelength radio transmission switch.

16. The multimedia alarm clock projector set forth in claim 10, further characterized in that said bottom wall comprises a battery compartment and at least one ventilation hole.

17. A multimedia alarm clock projector, comprising:

housing assembly comprising a time display and a docking port;

a detached speaker system;

a projector assembly comprising a projector having a focusing ring and lens, said projector further having electrical wiring, and a mount assembly and first base, said first base mounted onto said housing assembly, said projector projects a visual projection at any angle between approximate horizontal plane and to an approximate vertical plane;

the projector assembly comprises a tongue in groove configuration to facilitate rotational mounting of the projector on the housing assembly; and the housing assembly does not comprise an speaker system housed therein.

18. The multimedia alarm clock projector set forth in claim 17, further characterized in that said projector assembly further comprises a stationary ring fixed to said housing assembly, said stationary ring having a first lip.

19. The multimedia alarm clock projector set forth in claim 18, further characterized in that said projector assembly further comprises a rotational base plate comprising a second lip, a second base, and a channel, said rotational base plate is rotatably mounted onto said stationary ring, whereby said channel receives said first lip, said projector is mounted onto said rotational base plate.

20. The multimedia alarm clock projector set forth in claim 19, further characterized in that said rotational base plate comprises a cavity, said cavity partially receives said projector when said projector projects said visual projection at said approximate vertical plane.

* * * * *